United States Patent [19]

Birke et al.

[11] 3,984,197

[45] Oct. 5, 1976

[54] DEVICE FOR THE WET TREATMENT AND DRYING OF TEXTILE MATERIAL

[75] Inventors: Walter Birke; Hans-Ulrich von der Eltz; Franz Schon, all of Frankfurt am Main, Germany

[73] Assignee: Hoechst Aktiengesellschaft, Frankfurt am Main, Germany

[22] Filed: Oct. 24, 1974

[21] Appl. No.: 517,766

Related U.S. Application Data

[62] Division of Ser. No. 302,854, Nov. 1, 1972, Pat. No. 3,905,764.

[30] Foreign Application Priority Data

| | | |
|---|---|---|
| Mar. 25, 1972 | Germany | 2214713 |
| Oct. 12, 1972 | Germany | 2249987 |
| Oct. 12, 1972 | Germany | 2249509 |
| Oct. 12, 1972 | Germany | 2249997 |

[52] U.S. Cl. ..... 432/136; 432/8; 432/230; 34/115; 432/59

[51] Int. Cl.[2] ..... F27B 9/28

[58] Field of Search ..... 432/8, 59, 72, 60, 227, 432/228, 230, 159, 65, 136; 34/115; 118/47

[56] References Cited

UNITED STATES PATENTS

| | | | |
|---|---|---|---|
| 1,947,547 | 2/1934 | Fruth | 118/47 |
| 3,130,961 | 4/1964 | Verner et al. | 432/72 |
| 3,377,056 | 4/1968 | Boye | 432/60 |
| 3,542,501 | 11/1970 | Jones | 431/258 |
| 3,554,502 | 1/1971 | Rye | 432/8 |
| 3,590,495 | 7/1971 | Tyson | 432/8 |
| 3,635,748 | 1/1972 | Peoples | 118/47 |
| 3,739,483 | 6/1973 | Meier-Windhorst | 34/115 |
| 3,744,963 | 7/1973 | Flynn | 432/59 |
| 3,811,988 | 5/1974 | Fleissner | 34/115 |
| 3,827,854 | 8/1974 | Gildersleeve | 432/8 |

*Primary Examiner*—John J. Camby
*Assistant Examiner*—Henry C. Yuen
*Attorney, Agent, or Firm*—Curtis, Morris & Safford

[57] ABSTRACT

An apparatus for drying a material containing a burnable organic liquid by igniting and burning the liquid from the material, consisting of an enclosed burning chamber having at one end an inlet for the material to be dried, a combustion air inlet and an ignition means for igniting the burnable organic liquid and having at the opposite end transport means for drawing the material through the chamber, an outlet means for hot combustion gases and an outlet means for dried material.

24 Claims, 24 Drawing Figures

DEVICE FOR THE WET TREATMENT AND DRYING OF TEXTILE MATERIAL

This is a division, of application Ser. No. 302,854, filed Nov. 1, 1972, now U.S. Pat. No. 3,905,764.

It is known that wet treating processes such as washing and rinsing are carried out in aqueous baths, whereby, depending on the type of fibre, the processes are carried out at different temperatures and, if desired, with different additives of auxiliaries and whereby the material is subsequently dried in nearly all cases. Furthermore, wet treatment processes in organic solvents are known, among which halogenated hydrocarbons may be pointed out. After treating them in organic solvents these ones are removed from the material by evaporation and recovered in a suitable apparatus. All processes work on the principle that drying requires energy for removing the water or the organic solvents.

The object of the present invention is a process for rinsing or washing and subsequent drying of textile material, in which the material is treated with a bath consisting of or containing a burnable organic liquid, which process comprises drying the material by burning off this liquid.

As burnable organic liquids for the process of the invention are considered all burnable water-insoluble or water-miscible and - in combination with emulsifying agents - wate-insoluble liquids; however, for reasons of safety those liquids are not suitable which have too low ignition points, a development of heat which is too high and too low evaporation numbers. Particularly suitable are low aliphatic alcohols, especially methanol, moreover cyclic ethers, especially dioxane. The mentioned solvents are used separately or in mixture with water. It is also possible to use small amounts of such organic solvents which develop strong heat during the burning off process, especially when operating with impregnation baths which contain high portions of water. Preferred baths are those which contain about 10 to 90 % by volume of alcohol and 90 to 10 % by volume of water, preferably 30 to 80 % by volume of alcohol.

The process is suitable for practically all types of fibres of natural or synthetic origin as well as for all fibre mixtures. The textiles may have all processing states suitable for a continuous method of operation, for example in form of cables, combed material, threads, yarns, woven and knitted fabrics for non-wovens.

The process according to the invention is carried out in the following way: the material is treated — for example during the washing process — in a suitable equipment with a washing liquor which contains besides the detergent additives usual for this process different amounts of one or several burnable organic liquids. Then the fabric is rinsed once or several times with a bath having the same composition as in the case of the washing process, but without the addition of detergents. This rinsing process with liquors containing a burnable organic liquid may also be carried out after usual wet treatment processes performed in aqueous liquors, such as for example bleaching, washing and drying.

For the subsequent drying by burning, it is particularly suitable if the liquid being on the material to be dried consists of 30 to 90 % by volume of a lower aliphatic alcohol, preferably methanol, and of 70 to 10 % by volume of water. This is obtained by carrying out the washing and the rinsing process with a bath having the mentioned composition. If wet treating is performed in an aqueous bath the material is expediently rinsed with pure alcohol in order to obtain the proportions indicated.

According to a special variant of the process of the invention the material or the liquid on the material are adjusted before burning off — for reasons of safety — by cooling to such temperatures as to achieve that the moist material shows a temperature of below the ignition point of the liquid used. According to the speed chosen of the machine, temperatures of about 1° to 40°C, preferably 1° to 15°C, below the corresponding ignition point, are sufficient.

After rinsing, the material is squeezed off and dried by igniting the burnable organic solvent by means of a suitable ignition device and by burning it down completely. It is recommended to use for reasons of safety those mixtures of water and burnable organic solvents, the ignition points of which are above room temperature. In the case of these mixtures it is necessary that the ignition device is adjusted as to provide in the beginning the energy required for heating up the solvent vapors above the ignition point.

It has also been found according to the invention that mostly more advantageous results may be obtained if the burning off process of the liquid on the material is effected in connection with drying systems already known. In special cases the liquid on the material may also be burnt off from one side of the goods and by supplying additional heat, which is carried out according to the present invention preferably while passing the material around a rotating drum.

If the liquid on the material is heated up to temperatures above the ignition point of the solvent used in each case, for example by an infrared heating device, normally one ignition is sufficient. Ignition expediently takes place close by the heating device. When working with a rotating drying drum, heating of the material is carried out for example by an oil-heated drum, by an infrared or gas irradiation device or in the case of a perforated drum by means of hot air. Additional heating devices along the burning off areas are also an advantage when working with liquors which contain a high portion of water. Thus, it is possible to heat the steams up to such temperatures as to permit that these steams may be used directly or indirectly for fixation processes after drying. The addition of water also makes possible to control the speed of the burning off process. Thus, for each fibre material an optimum mixture may be found, which prevents the fibre material from burning during the burning off process of the liquor.

While burning off, a more or less strong singing effect appears which depends on the burnable solvent and on the water contents of the treating liquors and saves in many cases the usual singing treatment.

The advantage of the process according to the invention consists in the fact that the textile material may be dried after wet treating processes simply and, if desired, practically without any energy. It has been surprising that the fibre is not damaged by this treatment and that the textile technological properties, for example the touch of the material, is completely maintained. A further advantage of the process of the invention is that the burning off process — especially when using methanol — does not cause any substances which pollute air or water. The use of mixtures of methanol and water has the further advantage that the speed of the burning off process may be controlled in a simple way by modifying the mixture ratio, and that the natural humidity of the fibre may be better regulated.

The present invention will be more fully understood from the description given herein below and the accompanying drawings which are briefly described as follows:

FIG. 1 is a schematic illustration of a vertical cross-section of the apparatus showing a burning chamber, combustion air and material inlet means at the bottom thereof, vacuum means disposed outside and ahead of the material inlet means and combustion gas and material outlet means at the top of the chamber.

FIG. 2 is a schematic illustration of a vertical cross-section of the apparatus showing a burning chamber, material inlet means at the bottom thereof, material impregnating and cooling means disposed outside and ahead of the material inlet means and material outlet means at the top of the chamber and separated from said burning chamber but disposed within said apparatus and in combination therewith a second treating chamber.

Figure 1:
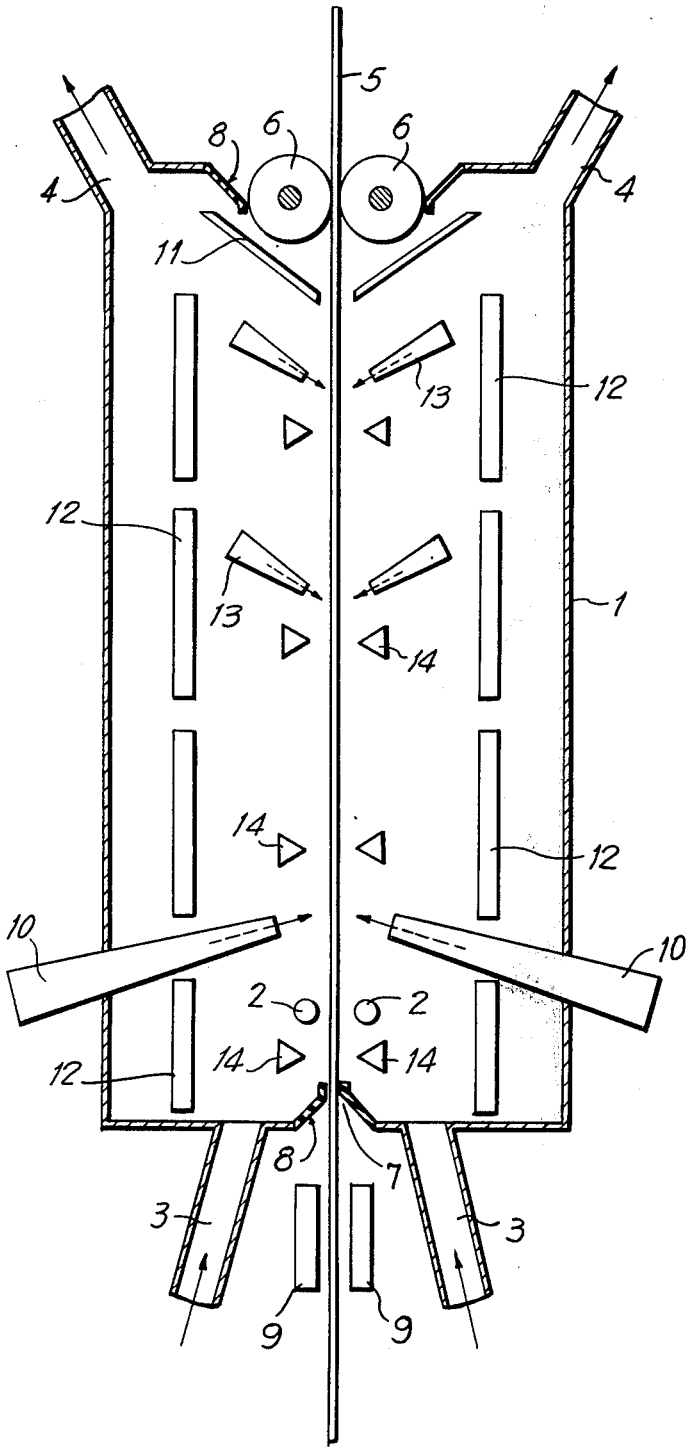

In FIG. 1 of the drawing there is shown a drying device suitable for carrying out the process and which is also concerned by the present process, generally consist of a burning off chamber (1) having an inlet and an outlet as well as transport means for the material when passing the equipment, an ignition element (2) and means for the supply of air (3) and for leading off the burning off gases and the steam (4). The material (5) may enter the burning off chamber from above or from below. Furthermore, certain safety devices must be available.

If the material is passed from below into the chamber, the ignition device must be adjusted as to insure a continuous burning of the solvent which enters the burning off chamber with the material. If the goods are passed in reverse sense the ignition device has to ignite the solvent vapors only once. The burning off process proceeds automatically, since the moist material is passed into the rinsing flame. In order to obtain a uniform drying of the web of fabric an ignition device must be present on each side of the web of fabric or on both borders. As ignition devices are considered for example gas flames or electric ignition devices.

For reasons of safety the burning off chamber is expediently sealed on the top by a pair of metal rolls (6).

At the lower part of the chamber an inlet or outlet slot is generally sufficient (7). The metal rolls as well as the inlet or outlet slot may be provided with sliding bands (8) or other not burnable sealings. The height of the chamber depends on the transport speed of the material and on the type and quantity of the burnable liquid used. For practical reasons the length of the burning off chamber is 0.5 to 10 meters, preferably 1 to 5 meters. The burning off chamber may have a completely or partly open form, whereby the lateral walls are completely or partly dispensed with.

At the upper end of the chamber are outlet openings (4) for the hot exhaust gases, which may be guided directly into a fixation chamber placed next to the burning off chamber. The air necessary for burning off is supplied from the outside by corresponding tubes (3). For reasons of safety a suction device (9) may be stored before the burning off chamber, which device provides that those solvent vapors are suctioned which are given off from the moist material before entering the chamber.

A further safety device or device for stopping the machine consists of nozzles (10) which, in the open or semi-open construction type, are directed on the burning off area and which, in the closed form, are placed within the burning off chamber or before the inlet opening and, if desired, before the outlet opening, and through which nitrogen or another gas which is not burnable and does not maintain the burning off process may be injected. The opening of these nozzles is expediently accompanied by stopping the supply of oxygen or air.

In the plant illustrated in FIG. 1 the material may also be passed from above to below. In this case the ignition device (2), the means for the supply of air (3) and the suction device (9) must be fixed at the upper part of the burning chamber.

The elements used for the transport of the goods are expediently protected against too strong heating by a heat shield (11). Furthermore they are adjustable in height, whereby the length of the drying distance may be varied. Along the web of fabric transported through the drying chamber are placed heating up devices (12) on both sides, which heat on one hand the burnable liquid being on the fabric above their ignition point and favour on the other hand the evaporation of the burnable liquid or of the water. Furthermore, they support the heating up of the burning off gases and of the steam, so that these ones may be directly or indirectly used for fixing proceses. Along the drying area are fixed control devices (14) for drying, the regulation of the speed of the material dependently of the burning off area and for the safety devices. The flame is controlled for example by bilateral air nozzles (13) which are also attached on swivel mountings along the burning off area.

Another safety device consists in fixing outside the material inlet into the chamber cooling elements for the material to be treated and impregnation bath. Those elements may be composed for example of a cooling trough with foulard rolls and a cooling drum.

Figure 2:
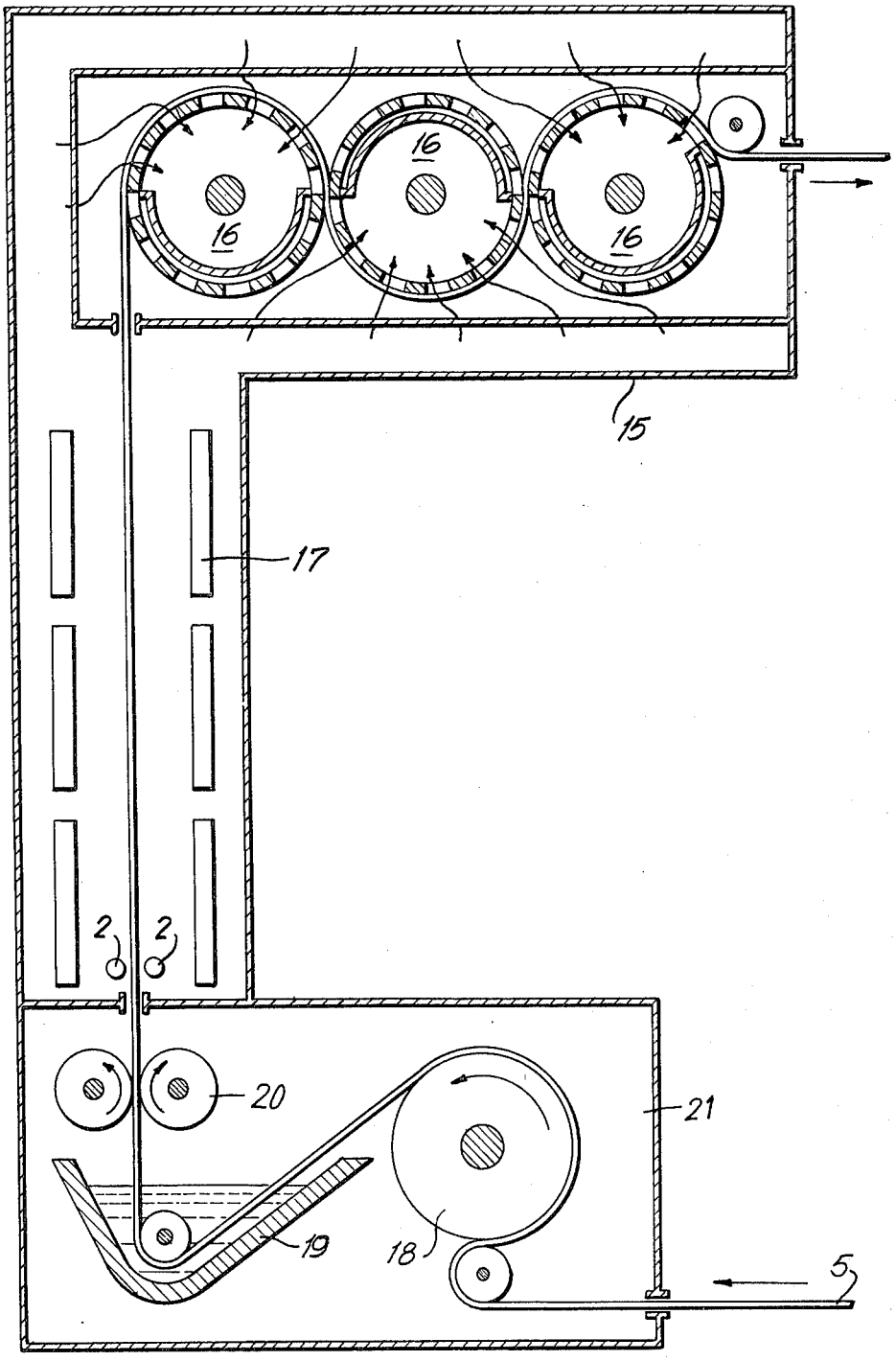

The FIG. 2 of the drawing illustrates the apparatus according to the present invention in combination with known finishing equipment. Figure II of the drawings shows the outside of the burning chamber and means ahead of the inlet for cooling the inflammable organic liquid to a temperature below its ignition point, which cooling means consist of a cooling drum which is brought into contact with the textile material and a liquid cooling bath through which said material passes prior to being fed to the inlet. Behind the burning chamber and separate therefrom there is a second heat treating chamber into which the dried material is fed. The heating in the second chamber is provided by hot combustion gases from the first chamber. The second heating chamber includes, as means for transporting the dried material through the second chamber, perforated drums which are operably associated with drive means causing the drums to rotate and to draw said material from the inlet to the outlet. The reference number used in FIG. 2 have the following meanings:

| | |
|---|---|
| 5 | web of fabric |
| 18 | cooling drum |
| 19 | cooling trough |
| 20 | foulard squeezing device |
| 21 | padding chamber under a slight under-pressure (311 to 911 mbar) |
| 2 | ignition device |
| 17 | infrared tunnel with infrared irradiators |
| 16 | sieve drums, at the same time for fixing |
| 15 | hot air distributing chamber |

Figure 3:
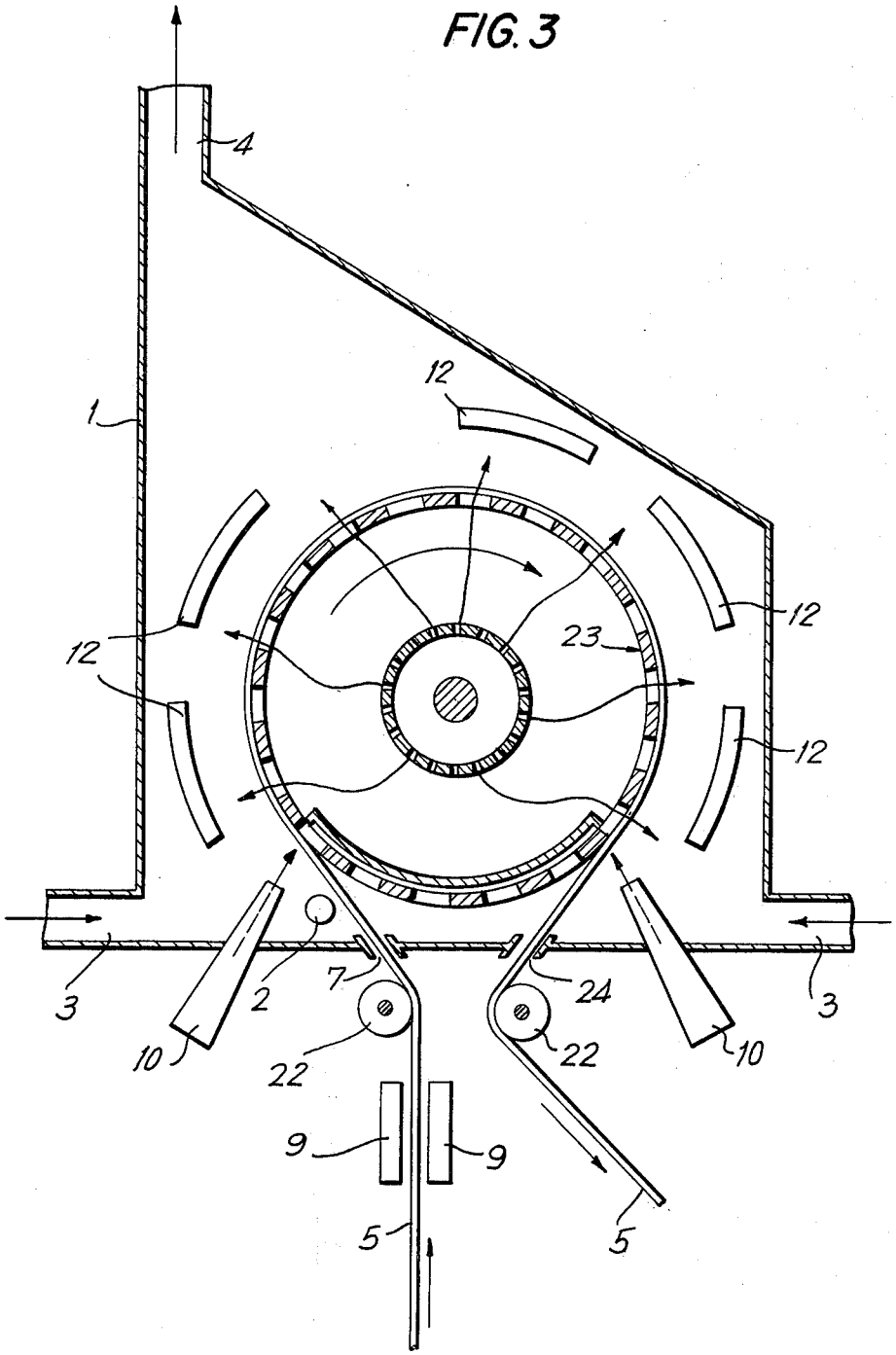
FIG. 3 is a schematic illustration of a vertical cross-section of the apparatus showing a burning chamber, material inlet means and combustion air inlet means at the bottom of the chamber, a perforated drum transport means disposed within the chamber, combustion gas outlet means in the top of the chamber and material outlet means in the bottom of the chamber.

FIG. 3 shows a modification of the above described types of the device according to the invention in case that a rotating perforated drum is used as transport mean for the material, wherein combustion air is supplied to only one side of said material, whereby the burning off of the burnable portions of the liquor is effected from one side. Suction means are provided before the inlet to remove inflammable organic liquid vapors from the material before the material enters the burning chamber. The reference numbers used in FIG. 3 have the following meanings:

FIG. 3

| | |
|---|---|
| 1 | burning off chamber |
| 2 | ignition device |
| 3 | supply of air |
| 4 | discharge of burning off gases and steam |
| 5 | web of fabric |
| 22 | guide rollers for the material |
| 7 | inlet slot |
| 23 | drying drum |
| 9 | suction device |
| 10 | safety nozzles |
| 12 | heating up devices |
| 24 | outlet slot |

According to the invention the dry drum in FIG. 3 may be closed or perforated. In the closed form for example hot water, steam or oil circulating in the drum arrange the impregnation liquor being on the material to be heated at a temperature superior to the ignition point. When using a perforated drum hot air is blown from one side through the textile material, which answers the same purpose. The diameter of this drum depends on the drying speed of the material.

Figure 4:
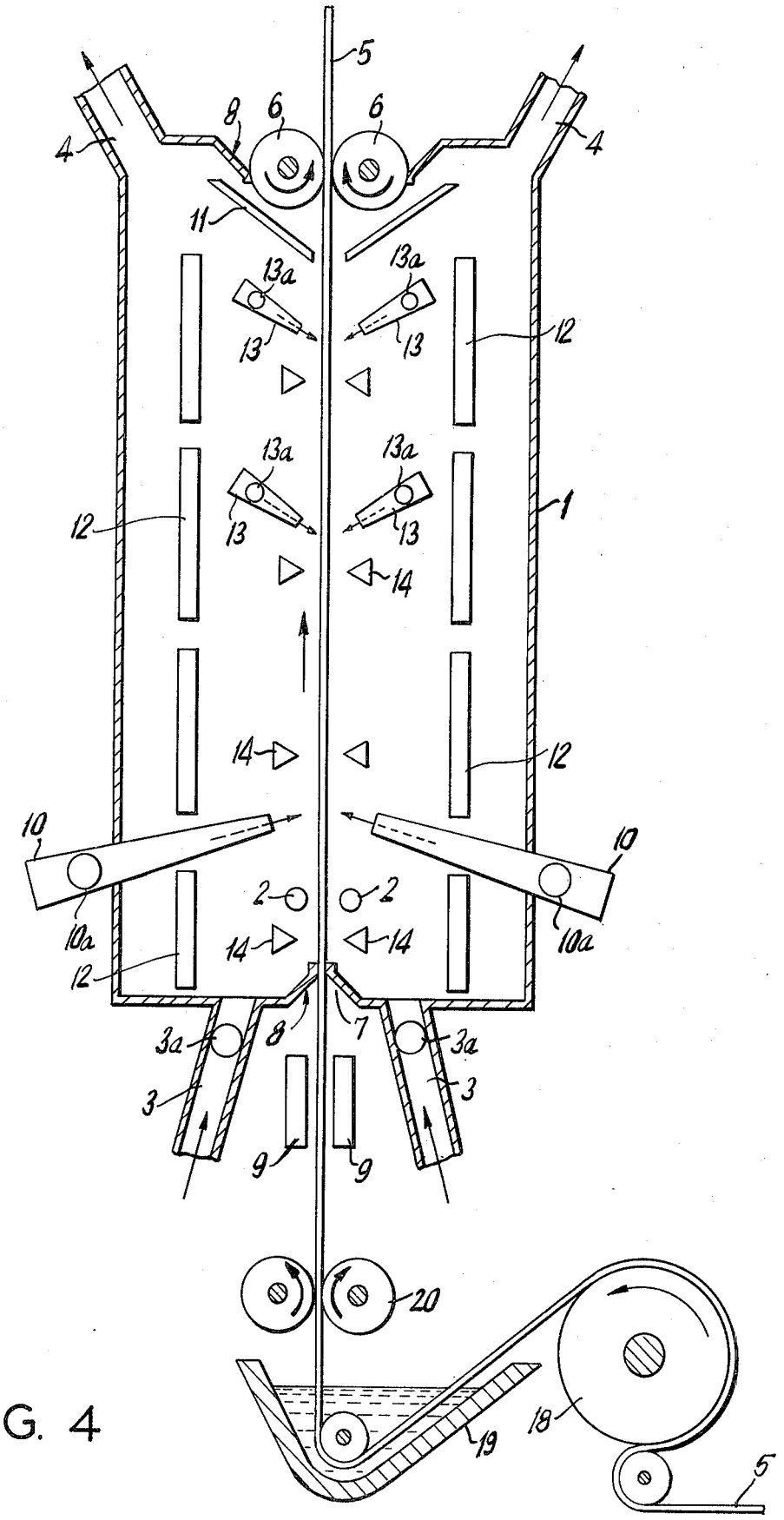
FIG. 4 is a schematic illustration of a vertical cross-section of the apparatus showing a burning chamber, combustion air and material inlet means at the bottom thereof, impregnating and cooling means disposed outside and ahead of the inlet means and combustion gas and material outlet means at the top of the chamber.

FIG. 4 of the drawings illustrates an embodiment of the invention in which an impregnating bath and cooling drum are disposed outside of the burning chamber and adjacent to the entrance to the burning chamber. The drawing also shows means 3 and 3a and 13 and 13a for supplying and for closing off the supply of combustion air and means 10 and 10a for supplying and for closing off the supply of a non-combustible gas to extinguish burning organic liquid.

Figure 5:
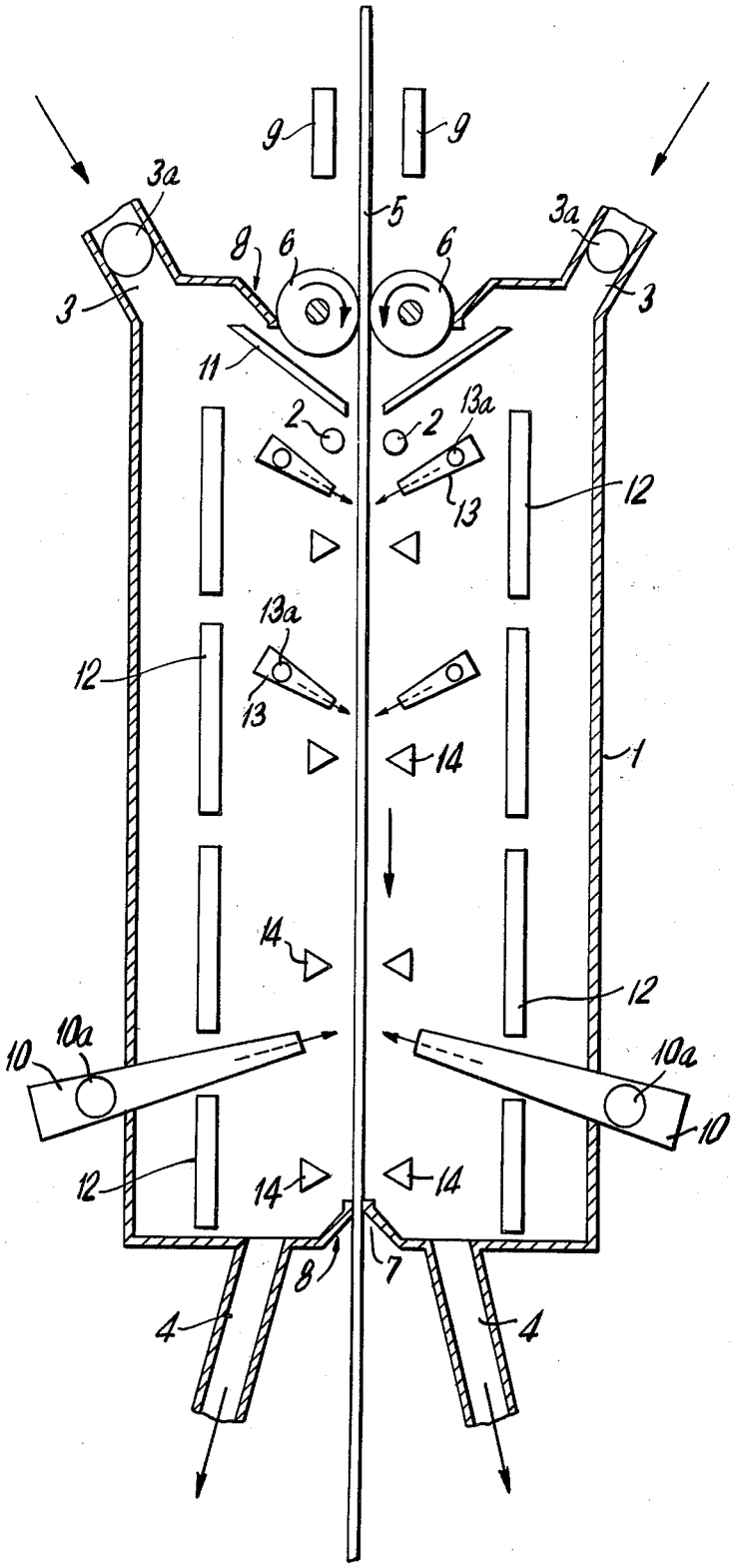
FIG. 5 is a schematic illustration of a vertical cross-section of the apparatus showing a burning chamber, combustion air and material inlet means at the top thereof, vacuum means disposed outside and ahead of the material inlet means and combustion gas and material outlet means at the bottom of the chamber.

FIG. 5 of the drawings illustrates an embodiment of the invention in which the material to be dried is fed into the top of the burning chamber and an ignition device, means for supply of air and suction device are provided at the upper part of the burning chamber.

Photo cells, thermo sensers or other control apparatuses allow to control the burning off process; thus, control apparatuses fixed below or above the ignition device, may control for example in the case of a back-running flame the above-mentioned safety devices and/or, if desired, the speed of the machine and influence the ignition device.

The following Examples illustrate the invention.

EXAMPLE 1

A mixed fabric of polyester fibres and cotton was treated on a full width washing machine (laboratory plant), in four compartments at 92° – 95°C, with an aqueous liquor which contained 1 g/l of a non-ionic detergent on the basis of an alkyl phenol polyglycol ether, 1 g/l of soda and 1 g/l of a sequestration agent on the basis of a polyphosphate. Between the individual compartments of the washing machine the material was squeezed off in each case. After this washing process the material was rinsed in further compartments of the washing machine first in hot water, then in cold water and finally twice in cold methanol.

After the last rinsing process in methanol the fabric was squeezed off and passed through a plant, in which the methanol was removed from the material by burning off and the material dried.

EXAMPLE 2

A woolen fabric was bleached in a usual manner in an aqueous bath and subsequently rinsed in cold water, squeezed off and then rinsed twice in cold ethanol and squeezed off in each case. The squeezing off effects were chosen in the way that the material contained — after the last squeezing off process — besides etanol 40 % of water, calculated on the weight of the fabric. The woolen fabric was continuously passed through a plant in which the material was dried by burning off the alcohol. After this drying by burning operation the woolen fabric contained a uniform moisture, which corresponded approximately to the natural moisture of this fibre.

Corresponding results were obtained if, instead of ethanol, dioxane was used.

EXAMPLE 3

A cotton material was dyed on a jigger in usual manner with vat dyestuffs, then rinsed, oxydated and soaped at the boil in usual manner. The material was then rinsed continuously, as described in Example 1, hot and cold in water and then rinsed three times in cold methanol and finally dried by burning off the solvent.

EXAMPLE 4

A mixed fabric consisting of 67 % of polyester fibres and 33 % of cotton was treated in a full width washing machine, as described in Example 1, in the following way: washing in four compartments of 50°C, with 0.5 g of the oxethylation product from 10 mols of ethylene oxide and 1 mol of nonyl phenol, per liter of a mixture consisting of 75 % by volume of methanol and 25 % by volume of water, rinsing in three compartments in the same methanol/water mixture.

After the last rinsing the material was squeezed off and passed through an equipment in which the methyl alcohol was removed from the material by burning off.

Similar results could be obtained if for the washing or rinsing liquors the following solvents or products were used: methanol and nonyl phenol oxethylated with 15 mols of ethylene oxide; isopropanol with 10 % by volume of water and tributyl phenol oxethylated with 18 mols of ethylene oxide; benzine (boiling range 60° to 95°C) and nonyl phenol oxethylated with 4 mols of ethylene oxide; benzine and isotridecyl alcohol oxethylated with 8 mols of ethylene oxide.

We claim:

1. An apparatus for drying a textile material containing a burnable organic liquid by igniting and burning the liquid from the material without harming or damaging the material, comprising a burning chamber having two opposing walls, two lateral walls and two end walls, one of said end walls having therein an inlet for the material to be dried and a combustion air inlet, means disposed outside of the burning chamber and approximate to the material inlet for producing on the material a burnable organic liquid, ignition means being mounted within said chamber and adjacent to said material inlet for igniting said burnable liquid while on said material, means for maintaining burning of said liquid including said combustion air inlet and the other of said end walls having therein an outlet for the dried material and an outlet for hot combustion gases and transport means for transporting the material through said chamber, said transport means being mounted on said burning chamber and adjacent to said material outlet and being operably connected to said end wall and burning chamber.

2. The apparatus of claim 1 wherein suction means are disposed outside of the burning chamber and adjacent to the material inlet and are operably connected to said burning chamber to remove burnable organic liquid vapors from the material before the material enters the burning chamber.

3. The apparatus of claim 1 wherein cooling means are disposed outside of the burning chamber and approximate to the material inlet and are operably connected to said burning chamber to maintain the burnable organic liquid and the material, prior to entering the burning chamber, at a temperature below the ignition temperature of the burnable organic liquid.

4. The apparatus of claim 1 including control means mounted in the burning chamber and disposed adjacent to and spaced along the material to be dried for controlling the ignition means, burning flame, speed of the material and safety devices.

5. The apparatus of claim 1 including heating means mounted in the burning chamber and disposed approximate to and spaced along the material to be dried for heating the burnable organic liquid to a temperature above its ignition temperation.

6. The apparatus of claim 1 including flame control means mounted in the burning chamber and disposed adjacent to and spaced along the material to be dried, wherein said flame control means comprise means for supplying air to the combustion flame.

7. The apparatus of claim 1 including flame control means mounted in the burning chamber and disposed adjacent to and spaced along the material to be dried, wherein said flame control means comprise air supply nozzles and the direction of the nozzles and the amount of air supplied to the flame through the nozzles are capable of being varied.

8. The apparatus of claim 1 including safety means mounted in the burning chamber and disposed approximate to the material inlet, for supplying a non-combustible gas capable of extinguishing burning organic liquid.

9. The apparatus of claim 1 including safety means for extinguishing the burning organic liquid, comprising means for closing off the supply of combustion air to the burning chamber.

10. The apparatus of claim 1 wherein the burnable organic liquid is a member selected from the group consisting of methanol and mixtures of methanol and water.

11. The apparatus of claim 1 wherein the burning chamber is enclosed.

12. The apparatus of claim 1 wherein combustion air is supplied to only one side of said material and burning off of the burnable organic liquid is from one side only.

13. The apparatus of claim 1 wherein combustion air is supplied to two sides of the material and burning off of the burnable organic liquid is from two sides.

14. The apparatus of claim 1 in which there is disposed outside of the burning chamber and before the material inlet, cooling means which consist of a liquid impregnating cooling bath through which said material passes prior to being fed to the material inlet, said cooling bath cooling the burnable organic liquid and the material to a temperature below the ignition temperature of the burnable organic liquid.

15. The apparatus of claim 1 in which there is disposed outside of the burning chamber and before the inlet means, cooling means which consists of a liquid impregnating bath through which said material passes and a cooling drum which drum is brought into contact with the material prior to the material being fed to the impregnating bath, whereby the burnable organic liquid and material are cooled to a temperature below the ignition temperature of the burnable organic liquid.

16. The apparatus of claim 1 wherein the burning chamber is vertically disposed, the inlet for the material and combustion air, and ignition means are at the lower end and the outlet for the hot combustion gases and transport means are at the upper end.

17. The apparatus of claim 1, wherein the burning chamber is vertically disposed, the inlet for the material and combustion air, and the ignition means are at the upper end.

18. An apparatus for drying a material containing a burnable organic liquid by igniting and burning the liquid from the material without harming or damaging the material, comprising a burning chamber having two opposing walls, two material walls and two end walls, one of said end walls having therein an inlet for the material to be dried and a combustion air inlet, means disposed outside of the burning chamber and approximate to the material inlet for providing on the material a burnable organic liquid, cooling means disposed outside of the burning chamber and approximate to the material inlet and operably connected to said burning chamber to maintain the burnable organic liquid and the material, prior to entering the burning chamber, at a temperature below the ignition temperature of the burnable organic liquid, ignition means being mounted within said chamber and adjacent to said material inlet, the other of said end walls having therein an outlet for the dried material and an outlet for hot combustion gases and transparent means for transporting the material through said chamber, said transport means being mounted on said burning chamber and adjacent to said material outlet and being operably connected to said end wall and burning chamber.

19. The apparatus of claim 18 wherein suction means are disposed outside of the burning chamber and adjacent to the material inlet and are operably connected to said burning chamber to remove burnable organic liquid vapors from the material before the material enters the burning chamber.

20. The apparatus of claim 18 including flame control means mounted in the burning chamber and disposed adjacent to and spaced along the material to be dried, wherein said flame control means comprise means for supplying air to the combustion flame.

21. The apparatus of claim 18 including safety means mounted in the burning chamber and disposed approximate to the material inlet for supplying a non-combustible gas capable of extinguishing burning organic liquid.

22. The apparatus of claim 18 including safety means for extinguishing the burning organic liquid, comprising means for closing off the supply of combustion air to the burning chamber.

23. The apparatus of claim 18 wherein the material to be dried is a textile material.

24. The apparatus of claim 18 wherein the burnable organic liquid is a member selected from the group consisting of methanol and mixtures of methanol and water.

* * * * *

UNITED STATES PATENT AND TRADEMARK OFFICE

CERTIFICATE OF CORRECTION

PATENT NO. : 3,984,197

DATED : October 5, 1976

INVENTOR(S) : Birke et al.

It is certified that error appears in the above-identified patent and that said Letters Patent are hereby corrected as shown below:

In the Heading, Item [30], line 4, replace "2249509" by --2249950--.

After the Abstract, Item [57], replace "24 Drawing Figures" by --5 Drawing Figures--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*